US008475079B2

(12) United States Patent
Humphries et al.

(10) Patent No.: US 8,475,079 B2
(45) Date of Patent: Jul. 2, 2013

(54) DRAINAGE APPARATUS INCLUDING A SUPPORT DEVICE AND A WEDGE

(75) Inventors: Derek Humphries, Apache Junction, AZ (US); James Allen McConnell, Montville, OH (US)

(73) Assignee: ACO Polymer Products, Inc., Chardon, OH (US)

( * ) Notice: Subject to any disclaimer, the term of this patent is extended or adjusted under 35 U.S.C. 154(b) by 373 days.

(21) Appl. No.: 13/007,752

(22) Filed: Jan. 17, 2011

(65) Prior Publication Data

US 2012/0183352 A1 Jul. 19, 2012

(51) Int. Cl.
*E02B 5/02* (2006.01)
*E02B 5/08* (2006.01)

(52) U.S. Cl.
USPC ..... 405/118; 404/3; 249/11

(58) Field of Classification Search
USPC ..... 405/36, 118, 119; 404/2–4; 249/8
See application file for complete search history.

(56) References Cited

U.S. PATENT DOCUMENTS

| | | | | |
|---|---|---|---|---|
| 733,396 | A * | 7/1903 | Beaumont | 249/9 |
| 1,202,269 | A * | 10/1916 | Cramer | 249/8 |
| 1,644,584 | A * | 10/1927 | Heltzel | 249/5 |
| 2,727,294 | A * | 12/1955 | Arrighini | 249/47 |
| 3,207,465 | A * | 9/1965 | Papin | 249/34 |
| 3,465,654 | A * | 9/1969 | Fox | 404/4 |
| 5,048,781 | A * | 9/1991 | Breen | 249/219.1 |
| 6,494,642 | B1 * | 12/2002 | Daly | 405/36 |
| 7,252,457 | B2 | 8/2007 | Humphries et al. | |
| 2005/0238436 | A1 * | 10/2005 | Wallace et al. | 405/118 |
| 2007/0274781 | A1 | 11/2007 | Aubusson et al. | |

* cited by examiner

*Primary Examiner* — Tara M. Pinnock
(74) *Attorney, Agent, or Firm* — Pearne & Gordon LLP

(57) ABSTRACT

A drainage apparatus comprises a support device including a support segment defining a clamp path, a first clamp member and a second clamp member. At least the second clamp member is configured to be coupled to the support segment while being free to translate along the clamp path. The drainage apparatus further includes a wedge including a drive axis, a first edge and a second edge. The wedge is tapered along the drive axis between the first edge and the second edge, and the wedge is configured to be driven in a direction of the drive axis into a locked orientation of the support device.

20 Claims, 5 Drawing Sheets

DRAINAGE APPARATUS INCLUDING A SUPPORT DEVICE AND A WEDGE

FIELD OF THE INVENTION

The present invention relates generally to drainage apparatus, and more particularly, to drainage apparatus including a support device and a wedge configured to be driven into a locked orientation of the support device.

BACKGROUND OF THE INVENTION

Drainage channels are commonly used to drain water or other liquids from a variety of environments. Drainage channels are known to be recessed within a trench and secured in place. Once secured, a grate is known to cap the drainage channel to allow liquids to pass into the drainage channel for subsequent collection or drainage to another location.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect of the present invention, a drainage apparatus comprises a support device including a support segment defining a clamp path, a first clamp member and a second clamp member. At least the second clamp member is configured to be coupled to the support segment while being free to translate along the clamp path. The drainage apparatus further includes a wedge including a drive axis, a first edge and a second edge. The wedge is tapered along the drive axis between the first edge and the second edge, and the wedge is configured to be driven in a direction of the drive axis into a locked orientation of the support device. The first edge engages the second clamp member and the second edge engages the support segment to lock the second clamp member relative to the support segment while clamping a portion of at least one conduit segment between the first clamp member and second clamp member.

In accordance with another aspect of the present invention, a drainage apparatus comprises at least one conduit segment and a support device. The support device includes a support segment defining a clamp path, a first clamp member and a second clamp member. At least the second clamp member is configured to be coupled to the support segment while being free to translate along the clamp path. The drainage apparatus further includes a wedge including a drive axis, a first edge and a second edge. The wedge is tapered along the drive axis between the first edge and the second edge and the wedge is configured to be driven in a direction of the drive axis into a locked orientation of the support device. In the locked orientation, the first edge engages the second clamp member and the second edge engages the support segment to lock the second clamp member relative to the support segment while clamping a portion of the conduit segment between the first clamp member and second clamp member.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
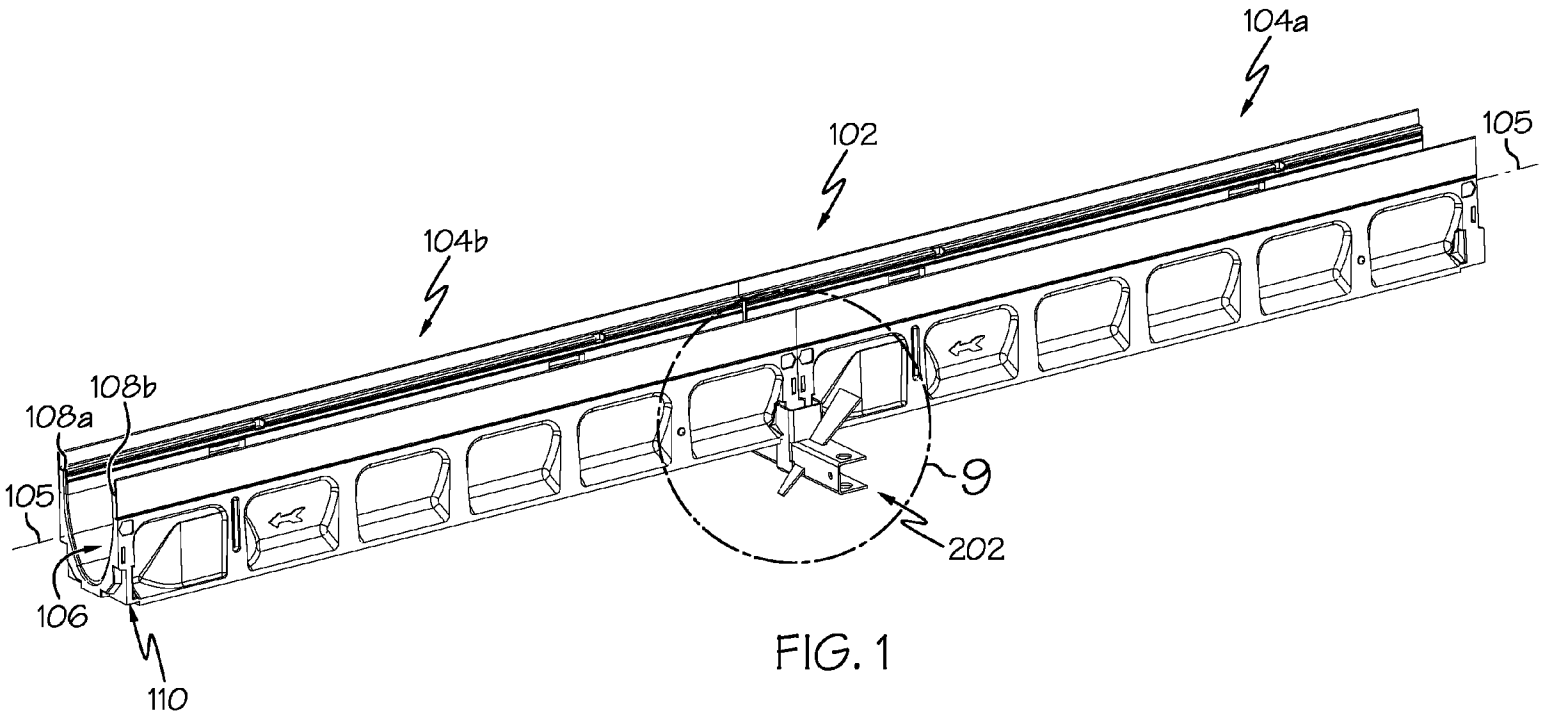
FIG. 1 illustrates a perspective view of an example drainage apparatus including an example support device in accordance with aspects of the disclosure.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Referring now to FIG. 1, a drainage apparatus 102 as set forth below can comprise a support device 202, and in some examples may also be considered to include at least one conduit segment in combination with the support device 202. For instance, in some examples, the drainage apparatus 102 may can include a single conduit segment or a plurality of segments. As illustrated, the at least one conduit segment can include a first conduit segment 104*a* and a second conduit segment 104*b* although three or more conduit segments may be provided in further examples. The drainage apparatus 102 may be used, for example, to drain surface water, act as a cable duct, or other applications. The drainage apparatus 102 can also be used in a wide range of environments such as walkways, bike and foot paths, outdoor malls, parking lots, factories, airport tarmacs, sports areas and other environments that require drainage of surface water or other fluids.

In one example, as discussed more fully below, the drainage apparatus 102 may be installed in a trench dug in the ground with a plurality of conduit segments joined end-to-end, supported in a properly aligned fashion, and then fixed in this position with concrete poured into the trench and around the drainage apparatus 102.

Example conduit segments can be substantially identical to one another and provided in a wide variety of shapes and sizes. As shown in FIG. 1, the conduit segments can comprise a U-shaped channel 106 although V-shaped or other channel shapes may be provided in further examples. Once installed, a grating (not shown) may be placed to rest on spaced shoulders 108*a*, 108*b*. The conduit segments may be fabricated from a wide range of materials. In one example, the conduit segments are molded from a polymer concrete although other materials and formation techniques may be used in further examples.

The drainage apparatus 102 can include one or more support devices configured to support one or more conduit segments. For instance, one or more support devices (e.g., the illustrated support device 202) may be used to support conduit segments that are joined end-to-end in a properly aligned fashion.

Figure 2:
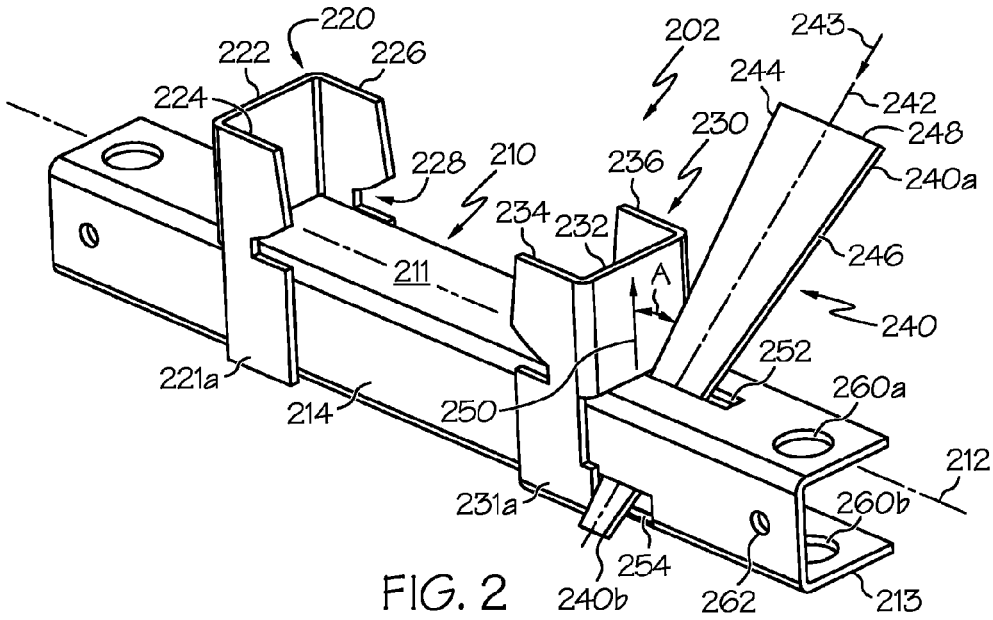
FIG. 2 is an upper front perspective view of the support device of FIG. 1.
Figure 3:
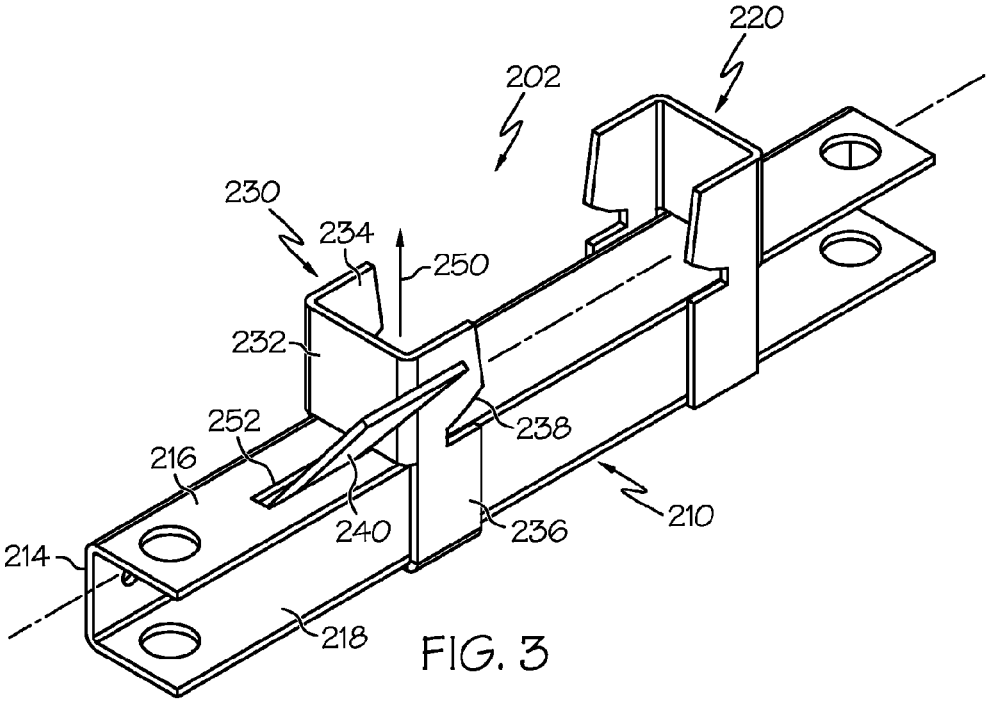
FIG. 3 is an upper rear perspective view of the support device of FIG. 1.

FIGS. 2 and 3 respectively illustrate upper front and rear perspective views of one example support device 202. As shown, the support device 202 can include a support segment 210 defining a clamp path 212. In one example, the support segment 210 includes a substantially C-shaped cross sectional profile including a base portion 214 and two side portions 216, 218, wherein the side portions 216, 218 are spaced apart from one another by the base portion 214. The support segment 210 can be formed by bending a strip of sheet metal into the C-shaped profile although other manufacturing techniques may be employed in further examples.

Figure 4:
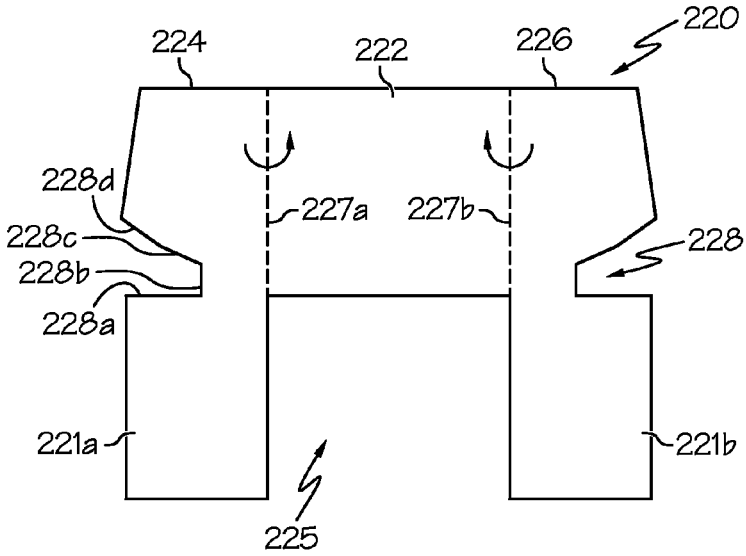
FIG. 4 is a plan view of a blank prior to bending to form the first clamp member of the support device.

The support device 202 further includes a first clamp member 220 and a second clamp member 230. The first and second clamp members can comprise a wide range of structures. For example, as shown in FIGS. 2-3, the first clamp member 220 can include a substantially C-shaped cross sectional profile including a base portion 222 and two side portions 224, 226, wherein the side portions 224, 226 are spaced apart from one another by the base portion 222. While other profiles shapes may be provided, the substantially C-shaped profile can formed from a substantially flat sheet of material, such as sheet metal or other material. For example, as shown in FIG. 4, a blank sheet of material can be machined by stamping, cutting or other technique to form a pair of notches 228 that face away from one another. The notches can include a landing 228*a*, a rear edge 228*b*, a first inclined portion 228*c* and a second inclined portion 228*d*. The blank further includes a pair of legs 221*a*, 221*b* that, together with the base portion 222, define a rectangular reception area 225. The C-shaped profile can be formed by bending the first side 224 and the second side 226 relative to the base portion 222 along bend lines 227*a*, 227*b*.

If provided with a C-shaped profile, the first clamp member 220 can then be adjustably or fixedly attached to the support segment 210. For example, as shown, the first clamp member 220 can be placed such that the support segment 210 is received within the rectangular reception area 225 of the first clamp member 220. The legs 221*a*, 221*b* then straddle the support segment 210 to help orient the first clamp member 220 in a substantially upright direction. Once seated, the landings 228*a* of the notches 228 can be arranged substantially along the same plane as a support surface 211 of the support segment 210. Once in the desired position along the clamp path 212, the first clamp member 220 can be fixed relative to the support segment 210. In one example, a set screw or other mechanical device may be used to fixed the first clamp member 220 in the desired location. In another example, the first clamp member 220 can be permanently fixed in position relative to the support segment 210. For instance, the first clamp member 220 can be formed as part of the support segment 210 or may be integrally attached to the support segment (e.g., by welding).

Figure 5:
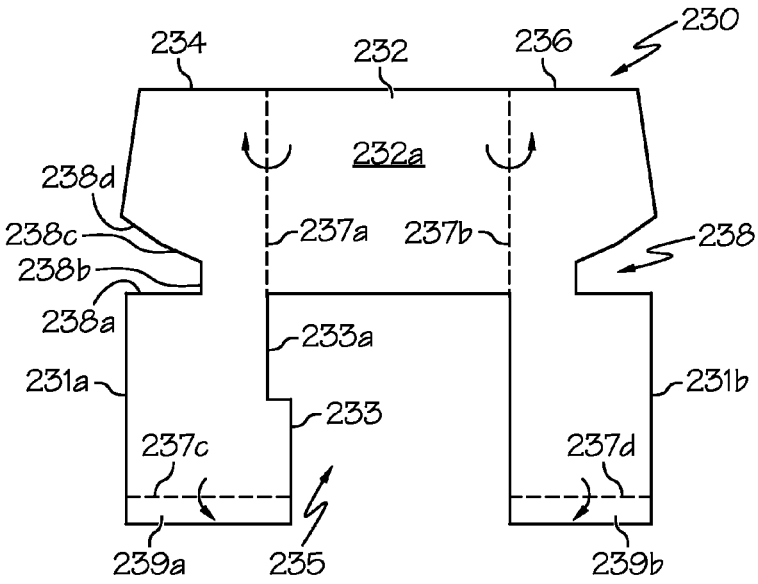
FIG. 5 is a plan view of a blank prior to bending to form the second clamp member of the support device.

As further illustrated, the second clamp member 230 can likewise include a substantially C-shaped cross sectional profile including a base portion 232 and two side portions 234, 236, wherein the side portions 234, 236 are spaced apart from one another by the base portion 232. While other profiles shapes may be provided, the substantially C-shaped profile can also be formed from a substantially flat sheet of material, such as sheet metal or other material. For example, as shown in FIG. 5, a blank sheet of material can be machined by stamping, cutting or other technique to form a pair of notches 238 that face away from one another. As The notches can include a landing 238*a*, a rear edge 238*b*, a first inclined portion 238*c* and a second inclined portion 238*d*. The blank further includes a pair of legs 231*a*, 231*b* that, together with the base portion 232, define a rectangular reception area 235. The C-shaped profile can be formed by bending the first side 234 and the second side 236 relative to the base portion 232 along bend lines 237*a*, 237*b*. Once bent into position, an edge 233*a* of a protrusion 233 may extend along the same plane as a substantially flat surface 232*a* of the base portion 232. Moreover, a pair of stops 239*a*, 239*b* may be bent from the ends of the pair of legs 231*a*, 231*b* along bend lines 237*c*, 237*d*.

With reference to FIG. 2, the second clamp member 230 can be assembled with the support segment 210 by inserting an end 213 through the rectangular reception area 235 of the second clamp member 230. Once inserted, the second clamp member 230 may be coupled to the support segment 210 while being free to translate along the clamp path 212. Moreover, as shown in FIG. 2, the bottom of the base portion 232 can ride along the support surface 211 defined by the first side portion 216 of the support segment. At the same time, the stops 239*a*, 239*b* can ride along the lower surface of the second side portion 218 of the support segment. Still further, the legs 231*a*, 231*b* can straddle the support segment 210. As such, the second clamp member 230 is configured to be substantially nonrotatably coupled to the support segment 210 such that the second clamp member 230 is maintained in a substantially upright direction 250 while being free to translate along the clamp path 212.

The support device 202 can further include a wedge 240 including a drive axis 242, a first edge 244 and a second edge 246. In one example, at least one of the first edge 244 and the second edge 246 is substantially straight although one or more of the edges may have an arcuate or other shape. Providing the first edge 244 as a substantially straight edge can help align the second clamp member 230 in the upright direction 250 illustrated in FIG. 3. Moreover, if substantially straight, the first edge 244 can be substantially parallel to the drive axis 242 to help maintain contact between the second clamp member 230 and the first edge 244 when driving the wedge 240 into a locking orientation of the support device 202. While the edges are illustrated as smooth straight edges, the edges may be serrated, cleated, or have other textures to facilitate maintenance of the locking orientation.

The wedge 240 is tapered along the drive axis 242 between the first edge 244 and the second edge 246. In one example, the taper can extend substantially the entire length of the wedge 240. For example, as shown, the wedge can be tapered from a first end 240*a* to a second end 240*b*. Providing the second edge 246 as a substantially straight edge can provide the wedge with a substantially constant taper. As such, a linear relationship between the clamping force and the distance the wedge has been driven can be achieved. In further examples, the second edge 246 may be arcuate to help provide a non-linear relationship between the clamping force and distance.

The wedge can also include a drive end 248 configured to receive an impact from a hammer or other tool to drive the wedge as discussed more fully below. As shown, the drive end 248 can comprise an edge that may extend between the first edge 244 and the second edge 246. As shown, one example edge associated with the drive end 248 can extend at a substantial orthogonal angle with respect to the first edge 244. As shown, the second end 240*b* can comprise a blunted tip such that the wedge is in the shape of a truncated right triangle.

The wedge 240 can be fabricated in a wide range of ways. In one example, the wedge 240 can be cut, stamped or otherwise machined from a substantially flat sheet of material. As such, the wedge can be inexpensively formed as a tapered plate that is substantially flat. Providing a substantially flat plate may be easily passed through preformed slots in the support segment 210. In further examples the plate may be curved to make inadvertent removal from the locked orientation more difficult.

It will therefore be appreciated that at least one of the support segment 210, the first clamp member 220, the second clamp member 230 and the wedge 240 can be formed from sheet metal. Moreover, one or more of the components may be formed from the same sheet of material to reduce costs.

Figure 6:
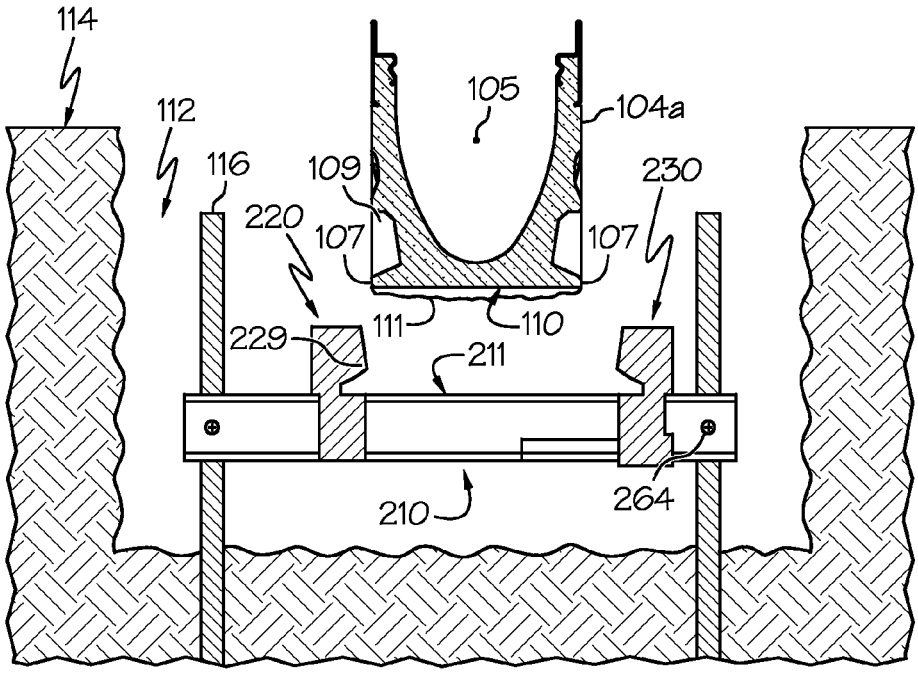
FIG. 6 illustrates the step of coupling the second clamp member to the support segment and mounting the support segment to an anchor during an example method of installing the drainage apparatus.
Figure 7:
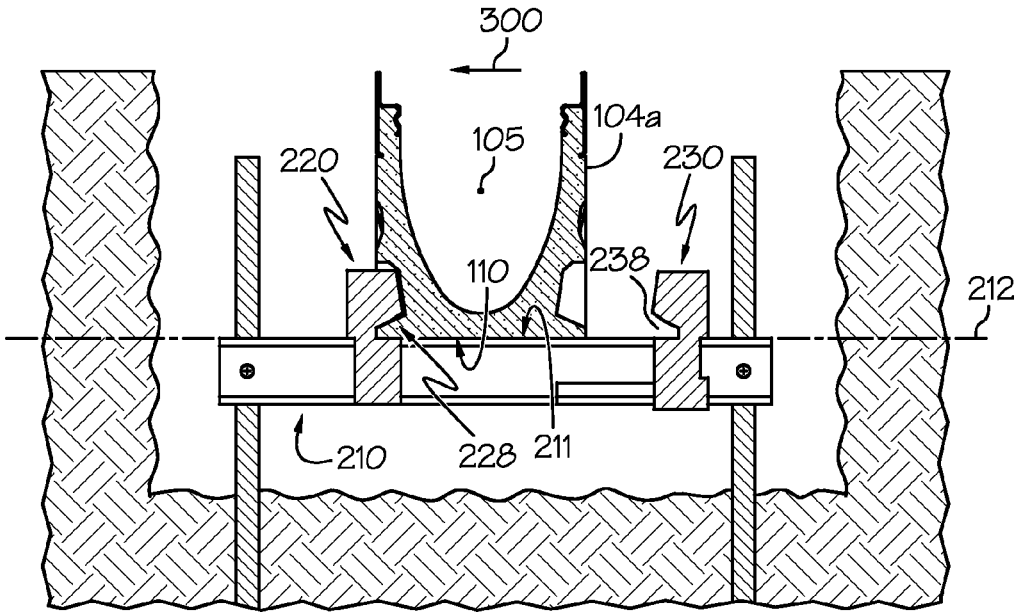
FIG. 7 illustrates a step of orienting a conduit segment to be at least partially supported by the support segment with a portion of the conduit segment positioned between the first clamp member and the second clamp member during the example method of installing the drainage apparatus.
Figure 8:
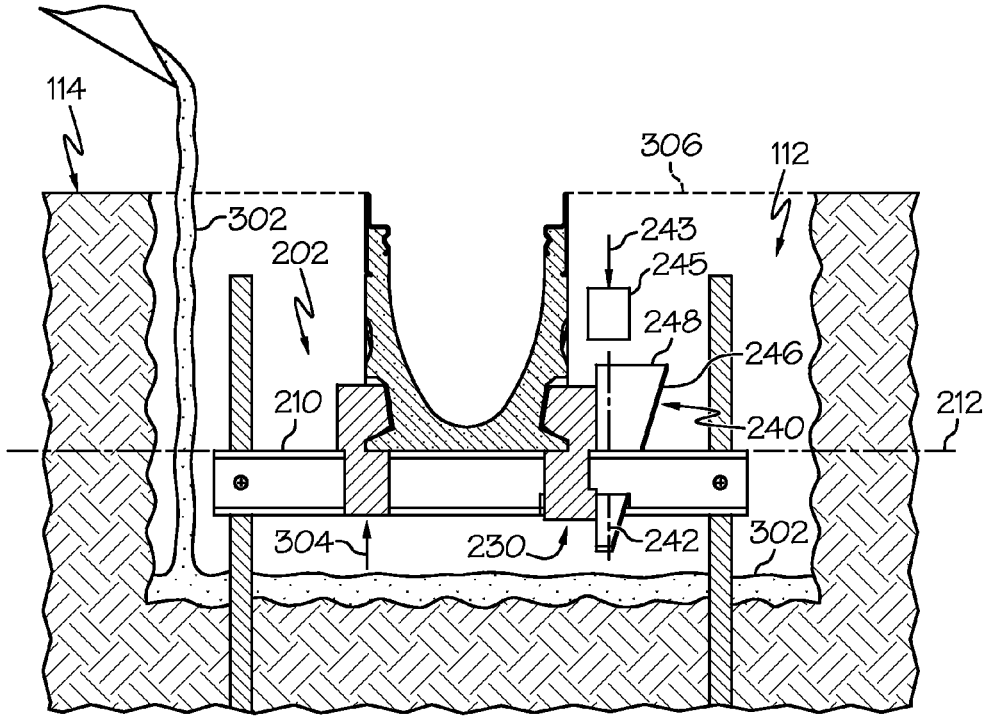
FIG. 8 illustrates the steps of translating the second clamp member along the clamp path toward the portion of the conduit segment and driving the wedge into a locked orientation of the support device during the example method of installing the drainage apparatus.

FIGS. 6-8 illustrate a method of installing the drainage apparatus 102 although other methods may be provided in further examples. While the support device 202 may be used to support a single conduit segment, as shown, the support device 202 can also be used to simultaneously support two corresponding ends of a pair of adjacent conduit segments 104*a*, 104*b*. The first conduit segment 104*a* is illustrated in FIGS. 6-8 with the understanding that the illustrated support device 202 can support both conduit segments 104*a*, 104*b* in the locked orientation of the support device 202.

As shown in FIG. 6, a trench 112 may be excavated into a ground surface 114. Anchors 116 may then be installed to provide a support foundation for the drainage apparatus 102. Various anchor configurations may be used in accordance with aspects of the disclosure. In one example, each anchor 116 can comprise a rod, such as rebar while other support structures may be used in further examples.

As discussed with respect to FIG. 2 above, the second clamp member 230 can then be coupled to the support segment 210 while being free to translate along the clamp path 212. Once the second clamp member 230 is coupled to the support segment 210, the support segment 210 can then be mounted to the anchors 116. As shown in FIG. 2, each end includes a pair of aligned apertures 260*a*, 260*b* defined in corresponding first and second side portions 216, 218 of the support segment 210. As shown in FIG. 6, each anchor 116 is inserted through a corresponding pair of aligned apertures 260*a*, 260*b*. The support segment is then adjusted to achieve the desired vertical support height relative to the anchors 116 within the trench 112. Once the desired height is achieved, the support segment 210 can be fixed in the desired position relative to the anchors 116. In one example, set screws 264 can be threaded through apertures 262 (see FIG. 2) in the base portion 214 of the support segment 210.

At least one of the conduit segments 104*a*, 104*b* may then be provided. In one example, the underside of the ends of the support segments are substantially flat to help properly seat the support segments with respect to the support device 202. For example, as shown in FIG. 6, the end portion of the conduit segment 104*a* includes a substantially flat base 110 when compared to a generally irregular shape 111 of central portions of the conduit segment. As such, the substantially flat base 110 can be rested on a substantially flat support surface 211 of the support segment 210 to properly seat the align the conduit segment 104*a*. Indeed, the end portions of the support segment 210 can be properly mounted with respect to the corresponding anchors 116 to provide a predetermined tilt angle that will properly orient the opening of the conduit segment 104*a* relative to the ground surface 114. As such, the interaction between the substantially flat base 110 of the conduit segment 104*a* with the substantially flat support surface 211 of the support segment 210 can allow efficient installation of a predetermined angle orientation of the conduit segment 104*a* about an elongated axis 105 that might not otherwise be easily achieved if the seated portion had the generally irregular shape 111 of the central portions of the conduit segment.

As shown in FIG. 7, once properly oriented, the conduit segment 104*a* can be at least partially supported by the support segment 210 with a portion of the conduit segment 104*a* positioned between the first clamp member 220 and the second clamp member 230. In one example, the conduit segment 104*a* can then be translated along a direction 300 of the clamp path 212 until the notches 228 engage a corresponding lip 107. At the same time, a nose 229 of the first clamp member 220 can be received in a corresponding recess 109 defined in the conduit segment 104*a*. During engagement, the second inclined portion 228*d* of the notch 228 can facilitate reception of the corresponding lip 107 in the notch 228 while the first inclined portion 228*c* can actually clamp against the surface of the corresponding lip 107.

In further examples, as shown in FIGS. 7-8, the second clamp member 230 can then be translated along the direction 300 of the clamp path 212 toward the portion of the conduit segment 104*a* until the notches 238 engage the corresponding lip 107 of the conduit segment 104*a*.

Figure 9:
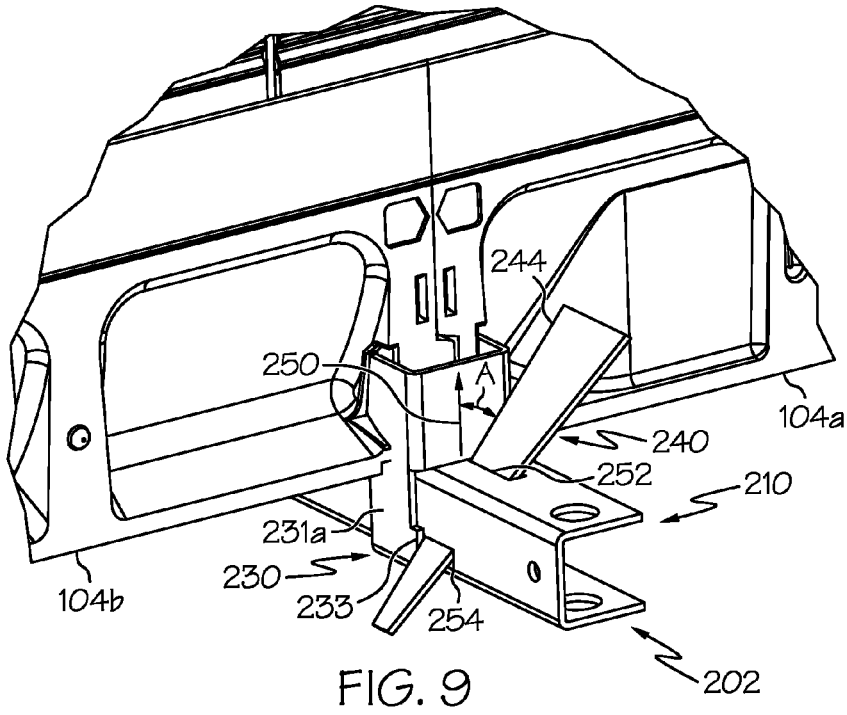
FIG. 9 is an enlarged view of FIG. 1, illustrating the driving wedge in the locked orientation.

Next, the driving wedge 240 can be driven in the direction 243 along the drive axis 242 into the locked orientation of the support device 202 as shown in FIGS. 8 and 9. As further illustrated, driving the wedge may be achieved by impacting the drive end 248 of the driving wedge 240 with a hammer 245 or other tool. As shown in FIG. 9, in the locked orientation, the first edge 244 engages the second clamp member 230 and the second edge 246 engages the support segment 210 to lock the second clamp member 230 relative to the support segment 210 while clamping a portion of at least one conduit segment 104*a*,104*b* between the first clamp member 220 and second clamp member 230.

In one example, in the locked orientation, the drive axis 242 of the wedge extends at an angle "A" with respect to the upright direction 250 of the second clamp member 230 with the first edge 244 of the wedge 240 diagonally engaging the second clamp member 230. A wide range of angles "A" may be used in accordance with aspects of the disclosure. In one example, the angle "A" can be in a range from about 5° to about 85°, such as from about 10° to about 80°, such as about 20° to about 70°, such as about 30° to about 50°, such as from about 35° to about 40°. In one example, the angle "A" is about 40°. Moreover, as shown in FIG. 8, in the locked orientation, the drive axis 242 of the wedge 240 is substantially perpendicular to a direction of the clamp path 212.

The support segment 210 can include one or more features to facilitate reception of the wedge 240. For example, as shown in FIGS. 2, 3 and 9, the support segment 210 includes at least one slot 252, 254 extending along the clamp path 212 configured to receive the wedge 240 in the locked orientation. While a single slot may be employed, as shown, the at least one slot can include two slots comprising a first slot 252 and a second slot 254 that permit the first edge 244 of the wedge 240 to diagonally engage the second clamp member 230 in the locked orientation.

As shown in FIGS. 2 and 9, one of the side portions 216, 218 of the support segment 210 includes the first slot 252 and another portion (e.g., the base portion 214) of the support segment 210 includes the second slot 254, wherein, in the locked orientation, the wedge 240 simultaneously extends through the first slot 252 and second slot 254 of the support segment 210 while diagonally engaging the second clamp member 230.

Diagonal positioning of the wedge 240 can be desirable to inhibit inadvertent unlocking of the support device 202 as discussed more fully below. Moreover, diagonal positioning of the wedge 240 can allow the wedge 240, in the locked orientation, to simultaneously diagonally engage the second clamp member 230 to help inhibit undesirable pivoting movement of the second clamp member 230 about the upright direction 250. Still further, diagonal engagement can also inhibit undesirable tilting of the second clamp member 230 about the clamp path 212.

Turning back to FIG. 5, a protrusion 233 can extend from a recess 233*a*. The recess 233*a* can facilitate bending of the blank along the bend line 237*a*. Moreover, as shown in FIG. 9, the edge of the protrusion 233 can be designed to be positioned along the same plane as the flat surface 232*a* of the base portion 232. As such, the first edge 244 of the wedge 240 can diagonally engage the second clamp member 230 at two diagonally spaced apart positions to further facilitate proper orientate of the second clamp member 230 relative to the support segment 210 in the locked orientation. For example, as shown, the first edge 244 of the wedge 240 can diagonally engage the edge of the protrusion 233 and the flat surface 232*a* of the base portion 232.

As shown in FIG. 9, in the locked orientation, the support device 202 can be designed to simultaneously support corresponding ends of the first and second conduit segments 104*a*, 104*b*. In the locked orientation, a strong joint can be achieved with the support device that allows proper orientation of the conduit segments 104*a*, 104*b* within the trench 112.

As shown in FIG. 8, concrete 302 may then be poured into the trench 112. During filling of the trench 112, the concrete moves in direction 304 toward the support device 202. Due to the diagonal positioning of the wedge 240, the force from the upwardly moving concrete 302 engaging the protruding end of the wedge 240 will frustrate inadvertent unlocking of the wedge 240 from the support segment 210. In some examples, the concrete can continued to be poured in the trench 112 until the level of the concrete 306 reaches the ground surface 114.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. A drainage apparatus comprising:

a support device including a support segment defining a clamp path, a first clamp member and a second clamp member, wherein at least the second clamp member is configured to be coupled to the support segment while being free to translate along the clamp path; and a wedge including a drive axis, a first edge and a second edge, wherein the wedge is tapered along the drive axis between the first edge and the second edge, and wherein the wedge is configured to be driven in a direction of the drive axis into a locked orientation of the support device wherein the first edge engages the second clamp member and the second edge engages the support segment to lock the second clamp member relative to the support segment while clamping a portion of at least one conduit segment between the first clamp member and second clamp member.

2. The drainage apparatus of claim 1, wherein the wedge comprises a tapered plate.

3. The drainage apparatus of claim 1, wherein at least one of the first edge and the second edge is substantially straight.

4. The drainage apparatus of claim 3, wherein the first edge is substantially straight and parallel to the drive axis of the wedge.

5. The drainage apparatus of claim 1, wherein the second clamp member is configured to be substantially nonrotatably coupled to the support segment such that the second clamp member is maintained in a substantially upright direction while being free to translate along the clamp path.

6. The drainage apparatus of claim 5, wherein, in the locked orientation, the drive axis of the wedge extends at an angle with respect to the upright direction of the second clamp member with the first edge of the wedge diagonally engaging the second clamp member.

7. The drainage apparatus of claim 1, wherein, in the locked orientation, the drive axis of the wedge is substantially perpendicular to a direction of the clamp path.

8. The drainage apparatus of claim 1, wherein the support segment includes at least one slot extending along the clamp path configured to receive the wedge in the locked orientation.

9. The drainage apparatus of claim 8, wherein the at least one slot includes two slots that permit the first edge of the wedge to diagonally engage the second clamp member in the locked orientation.

10. The drainage apparatus of claim 1, wherein at least one of the support segment, the first clamp member, the second clamp member and the wedge is formed from sheet metal.

11. The drainage apparatus of claim 1, wherein the support segment includes a substantially C-shaped cross sectional profile including a base portion and two side portions, wherein the side portions are spaced apart from one another by the base portion.

12. The drainage apparatus of claim 11, wherein one of the side portions of the support segment includes a first slot and another portion of the support segment includes a second slot, wherein, in the locked orientation, the wedge simultaneously extends through the first and second slot of the support segment while diagonally engaging the second clamp member.

13. The drainage apparatus of claim 11, wherein one of the side portions of the support segment includes a first slot and the base portion of the support segment includes a second slot, wherein, in the locked orientation, the wedge simultaneously extends through the first and second slot of the support segment while diagonally engaging the second clamp member.

14. The drainage apparatus of claim 1, wherein the second clamp member includes a substantially C-shaped cross sectional profile including a base portion and two side portions, wherein the side portions are spaced apart from one another by the base portion.

15. The drainage apparatus of claim 14, wherein, in the locked orientation, the wedge simultaneously diagonally engages the base portion and one side portion of the second clamp member.

16. A drainage apparatus comprising:

at least one conduit segment;

a support device including a support segment defining a clamp path, a first clamp member and a second clamp member, wherein at least the second clamp member is configured to be coupled to the support segment while being free to translate along the clamp path; and a wedge including a drive axis, a first edge and a second edge, wherein the wedge is tapered along the drive axis between the first edge and the second edge, and wherein the wedge is configured to be driven in a direction of the drive axis into a locked orientation of the support device wherein the first edge engages the second clamp member and the second edge engages the support segment to lock the second clamp member relative to the support segment while clamping a portion of the conduit segment between the first clamp member and second clamp member.

17. The drainage apparatus of claim 16, wherein the second clamp member includes a substantially C-shaped cross sectional profile including a base portion and two side portions, wherein the side portions are spaced apart from one another by the base portion and, in the locked orientation, each side portion includes a notch receiving a portion of the conduit segment.

18. The drainage apparatus of claim 16, wherein, in the locked orientation, a substantially flat base of the at least one conduit segment is supported by a substantially flat support surface of the support segment.

19. The drainage apparatus of claim 16, wherein the at least one conduit segment includes a first conduit segment and a second conduit segment, wherein, in the locked orientation, the support device simultaneously supports corresponding ends of the first and second conduit segments.

20. A method of installing the drainage apparatus of claim 16 comprising the steps of:

coupling the second clamp member to the support segment while being free to translate along the clamp path;

mounting the support segment to an anchor;

orienting the conduit segment to be at least partially supported by the support segment with the portion of the conduit segment positioned between the first clamp member and the second clamp member;

translating the second clamp member along the clamp path toward the portion of the conduit segment; and driving the wedge in the direction along the drive axis into the locked orientation.

* * * * *